US007357082B1

(12) United States Patent
Racho

(10) Patent No.: US 7,357,082 B1
(45) Date of Patent: Apr. 15, 2008

(54) MODIFIED SHOTGUN AND MODIFIED SHOTGUN SHELL AMMUNITION

(76) Inventor: Jeffrey Racho, P.O. Box 486, Hazleton, PA (US) 18201

( * ) Notice: Subject to any disclaimer, the term of this patent is extended or adjusted under 35 U.S.C. 154(b) by 5 days.

(21) Appl. No.: 11/526,446

(22) Filed: Sep. 25, 2006

Related U.S. Application Data

(60) Provisional application No. 60/742,413, filed on Dec. 5, 2005, provisional application No. 60/740,946, filed on Nov. 30, 2005, provisional application No. 60/720,791, filed on Sep. 27, 2005.

(51) Int. Cl.

| | |
|---|---|
| ***F42B 7/00*** | (2006.01) |
| ***F42B 7/02*** | (2006.01) |
| ***F42B 5/08*** | (2006.01) |
| ***F42B 10/00*** | (2006.01) |
| ***F42B 14/00*** | (2006.01) |
| ***F41A 19/00*** | (2006.01) |

(52) U.S. Cl. ..... 102/439; 102/449; 102/457; 102/472; 102/517; 102/520; 89/28.05; 42/84

(58) Field of Classification Search ..... 89/28.05; 102/439, 449, 457, 472, 517, 520; 42/84
See application file for complete search history.

(56) References Cited

U.S. PATENT DOCUMENTS

| | | | | |
|---|---|---|---|---|
| 949,063 | A * | 2/1910 | Dorn | 102/438 |
| 4,852,457 | A * | 8/1989 | Schlegel et al. | 89/6.5 |
| 4,864,935 | A * | 9/1989 | Schlegel et al. | 102/438 |
| 5,883,329 | A * | 3/1999 | O'Dwyer | 102/217 |
| 6,247,411 | B1 * | 6/2001 | Vornfett | 102/472 |
| 6,247,412 | B1 * | 6/2001 | Vornfett | 102/472 |
| 6,301,819 | B1 * | 10/2001 | O'Dwyer | 42/84 |
| 6,374,525 | B1 * | 4/2002 | Thomas | 42/51 |
| 6,431,070 | B1 * | 8/2002 | La Mura | 102/202.11 |
| 6,505,558 | B1 * | 1/2003 | La Mura et al. | 102/217 |
| 6,539,874 | B2 * | 4/2003 | Weise | 102/472 |
| 6,543,174 | B2 * | 4/2003 | O'Dwyer | 42/76.01 |
| 6,543,330 | B2 * | 4/2003 | Breuer et al. | 89/28.05 |
| 6,557,449 | B1 * | 5/2003 | O'Dwyer | 89/1.41 |
| 7,007,586 | B2 * | 3/2006 | Larroque-Lahitette et al. | 89/135 |

(Continued)

OTHER PUBLICATIONS

EIC Laboratories, Inc., Informational Website on ElectRelease epoxy (http://www.eiclabs.com, accessed Sep. 1, 2006).
Dakota Ammo, Inc./Glaser LLC, Informational Website on Glaser Safety Slug ammunition (http://www.dakotaammo.net, accessed Sep. 1. 2006).

(Continued)

*Primary Examiner*—Victor Batson
*Assistant Examiner*—Michael D David
(74) *Attorney, Agent, or Firm*—Jeffrey Racho, Esq.

(57) ABSTRACT

A shotgun which allows its operator to fire modified ammunition rounds as either slug rounds or rounds of shot. The shotgun is modified by the addition of components creating an electric circuit in the shotgun. The modified ammunition rounds contain a modified slug round formed by a plurality of shot pellets held together by an epoxy which disbonds upon the application of an electric current. The operator of the shotgun may choose which type of round to fire by operating a selector switch component installed in the shotgun. The shotgun may include a modification to its trigger in which the trigger acts as the switching mechanism to disbond the epoxy binding the shot pellets in the modified slug round.

19 Claims, 9 Drawing Sheets

U.S. PATENT DOCUMENTS

| | | | | |
|---|---|---|---|---|
| 7,194,943 | B2 * | 3/2007 | O'Dwyer | 89/28.05 |
| 2002/0002787 | A1 * | 1/2002 | O'Dwyer | 42/84 |
| 2002/0046643 | A1 * | 4/2002 | Breuer et al. | 89/28.05 |
| 2004/0231219 | A1 * | 11/2004 | O'Dwyer | 42/84 |
| 2005/0246934 | A1 * | 11/2005 | O'Dwyer | 42/84 |
| 2006/0288897 | A1 * | 12/2006 | Williams et al. | 102/364 |
| 2007/0023929 | A1 * | 2/2007 | Sandberg | 257/783 |

OTHER PUBLICATIONS

Glock, Inc., Informational Website on Glock pistols (http://www.glock.com, accessed Sep. 1, 2006).

Springfield Armory, Informational Website on Springfield Armory pistols (http://www.springfield-armory.com, accessed Sep. 1, 2006).

* cited by examiner (prior art)

MODIFIED SHOTGUN AND MODIFIED SHOTGUN SHELL AMMUNITION

CROSS REFERENCE TO RELATED APPLICATIONS

This nonprovisional patent application claims the benefit of the filing dates of the following provisional applications, which are herein incorporated by reference: 60/720,791, filed Sep. 27, 2005; 60/740,946, filed Nov. 30, 2005; and 60/742,413, filed Dec. 5, 2005.

BACKGROUND OF THE INVENTION

A review of certain aspects of the background of the invention provides insight into how the invention operates and the benefits provided by the invention. A discussion of the types of shotgun ammunition types is presented, followed by a discussion of the shortcomings of the use of the shotgun as a tactical weapon by a soldier or law enforcement officer.

Description of Shotgun Ammunition Types

Shotguns have two general type of ammunition: slugs and shot. "Slug" shells are shotgun shells that fire a single, solid projectile. Slugs are either rifled rounds and fired through smoothbore barrels, or non-rifled rounds fired through rifled barrels. In the case of non-rifled slug rounds, the slug is encased in a sabot, which is a plastic ring or cylinder surrounding the slug. The sabot is gripped by the rifling of the barrel, thereby spinning the sabot and slug. The spinning motion stabilizes the slug during its flight towards the target; the sabot falls away from the slug when the round leaves the barrel of the firearm. Saboted slug rounds are often used for hunting game such as deer and are generally accurate and effective to 100 yards.

"Shot" shells are shotgun shells that contain a group of pellets (called the "shot"), made of either lead or a lead substitute material. The shot spreads into a shot pattern after leaving the barrel of the firearm, increasing the likelihood that at least one of the pellets will strike the target. The shot round is extremely effective at close ranges, but the pellets quickly lose their kinetic energy and lose their effectiveness the further they travel from the firearm. Thus, although a shot-loaded shotgun is effective at close ranges, it must be unloaded and then loaded with a slug shell if the target is outside the effective range of the shot shell. Shot generally takes the form of spherical pellets, but may sometimes exist as "cubic shot," in which the pellets take the form of cubes. Cubic shot is used when a wider dispersal of the shot pellets is required since their cubic appearance causes them to "tumble" while in flight, making their trajectory more erratic than that of spherical shot pellets.

Additional types of shotgun ammunition include flechette rounds, in which the shot pellets are replaced by small darts, and disintegrator or "Hatton" rounds (in which the shot pellets are replaced by a mixture of metal powder and wax) which are used for breaching locked doors.

The "Combat" Shotgun

World War I saw the use of the Winchester Model 1897 pump-action shotgun by the United States military. These "combat" shotguns were loaded with buckshot shells, buckshot being a large-sized pellet loaded into the shell. Buckshot shells generally contained eight to nine pellets of buckshot where each pellet was about 0.3" in diameter. The effectiveness of the combat shotgun made it an ideal weapon for close-range combat during trench warfare and its use continued in the U.S. military for certain applications. The shotgun is also used by law enforcement agencies should their officers be required to engage criminals in short-range firearms exchanges, such as those inside dwellings or buildings.

A soldier (or law enforcement officer) equipped with a combat shotgun faced one dilemma—how to neutralize an enemy who was outside the short, effective range of the buckshot-loaded shells he carried in his combat shotgun. This problem reduced the effectiveness of the combat shotgun-equipped soldier in that his weapon's range was severely limited, thereby making him both less able to defend himself against an enemy equipped with a rifle and making him unable to assist the other soldiers of his unit in certain situations. The soldier could carry slug shells into combat; he would, however, be burdened by more weight and would have to remove the buckshot shells from the combat shotgun and replace them with slug rounds whenever he encountered an enemy outside the range of his buckshot shells.

BRIEF SUMMARY OF THE INVENTION

The claimed invention is a modified shotgun (the "Modified Shotgun"), preferably taking the form of a "pump-action" or autoloading shotgun, and a modified type of shotgun shell ammunition (the "Modified Shell") which is used in conjunction with the Modified Shotgun. The components of the Modified Shotgun include a switch which the operator of the Modified Shotgun may use to select either "slug" or "shot" rounds. The components of the Modified Shotgun will operate in conjunction with the Modified Shell in the firearm's firing chamber so that the Modified Shotgun will fire either a slug round or a round of shot, allowing the operator to fire either type of round without the requirement of removing one type of ammunition from the firearm and replacing it with the alternative. The invention thus allows the operator to fire both slug rounds at distant targets and shot rounds at closer targets without being burdened by carrying two different types of ammunition shells.

The Modified Shell comprises a hull having a plurality of points of contact (constructed of electrically conductive material) allowing the passage of an electric current into the shotgun shell at the points of contact; a sabot having a plurality of leads constructed of electrically conductive material, the leads allowing the passage of an electric current from the points of contact on the hull to a projectile; and a projectile, comprised of a plurality of pellets constructed of a core of a dense metal (such as lead) coated by an electrically conductive material and held together by an epoxy having the characteristic that it disbonds upon the application of an electric current.

The Modified Shotgun comprises a firing trigger used to fire the shotgun; a power source; a selector switch with a plurality of positions, wherein at least one setting of the selector switch is a position which causes no electric current to flow from the power source, and at least one setting of the selector switch is a position which causes an electric current to flow from the power source; a plurality of electrical contacts located in the chamber of the shotgun, the plurality of electrical contacts making contact with the plurality of points of contact on the hull of the shotgun shell; and electrically conductive material which forms a circuit comprising the power source, selector switch, and plurality of electrical contacts located in the chamber of the shotgun, the circuit completed when the shotgun shell is loaded into the chamber of the shotgun.

It is to be understood that both the foregoing general description and the following detailed description are exemplary, but are not restrictive, of the invention.

BRIEF DESCRIPTION OF THE DRAWING

Included in the drawing are the following figures in which like reference numbers refer to like elements throughout the various figures that comprise the drawing.

Figure 1A:
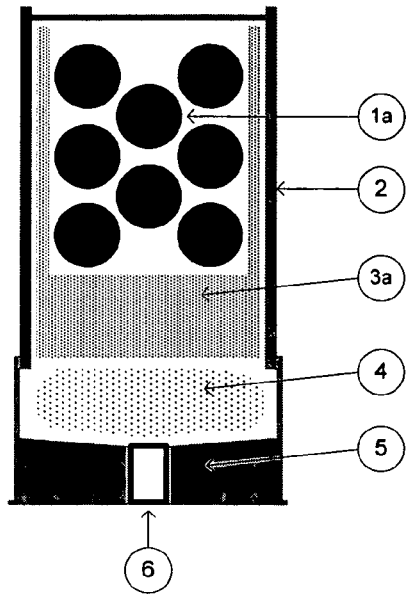
FIG. 1A depicts the interior of a "shot" type of conventional shotgun shell.

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity.

DETAILED DESCRIPTION OF THE INVENTION

A person skilled in the arts of manufacturing and/or designing firearms and other mechanical devices may make the Modified Shotgun component of the invention by either modifying existing shotguns to yield the Modified Shotgun by adding the parts described herein or by building a new shotgun with the parts described herein integrated into the design of the new shotgun. A person skilled in the arts of manufacturing and/or designing firearms and other mechanical devices may make the Modified Slug and Modified Shell components of the invention from the parts described herein.

Shotgun Shells—Prior Art

Figure 1B:
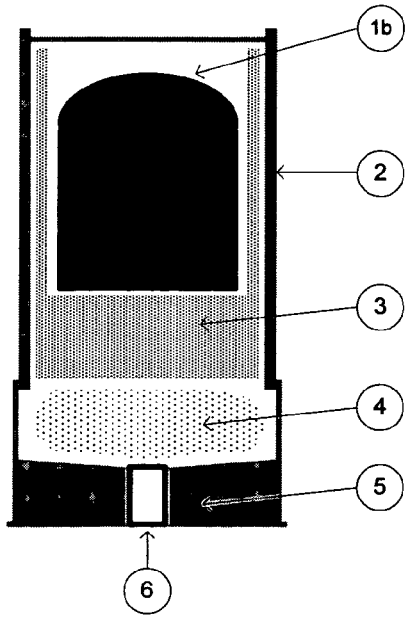
(prior art) Fig. 1B
FIG. 1B depicts the interior of a "slug" type of conventional shotgun shell.
Figure 2A:
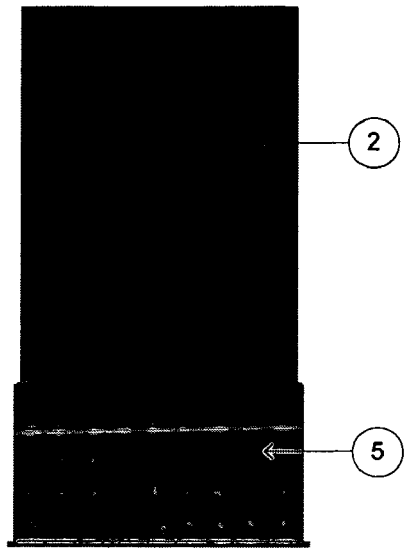
FIG. 2A depicts the exterior of a conventional shotgun shell.

FIGS. 1A and 1B illustrate the interior of the two general types of shotgun shells, "shot" loaded shells (FIG. 1A) and "slug" loaded shells (FIG. 1B). Both types of shells have the same exterior appearance, which is depicted in FIG. 2A. As seen in FIG. 2A, shotgun shells consist of a hull (2) made of plastic and attached to a brass body (5).

FIG. 1A depicts the interior of a shell loaded with shot. The shot pellets (1*a*) are placed inside a plastic cup (3*a*). Both are then inserted inside the hull (2), which is attached to the brass body (5). The rear end of the plastic cup is sometimes accompanied by a "wadding" (not depicted) which acts as a buffer between the cup and the gunpowder (4) inside the shell; in most shotgun shells, the rear end of the plastic cup itself acts as the wadding. The gunpowder in the shell sits inside the brass body and is ignited by the primer (6) which is struck by the shotgun's firing pin. When the shotgun's trigger is pulled, the firing pin strikes the primer, which ignites the gunpowder, which then burns. The expanding gas resulting from the burning powder pushes the cup and shot through the shotgun's barrel and thereupon towards the target.

FIG. 1B depicts the interior of a shell loaded with a slug. The shot pellets are replaced by a single, solid metal slug (1*b*) usually made of lead. The slug is surrounded by a plastic sabot (3). The sabot and slug are inserted inside the hull (2), which is attached to the brass body (5). The rear end of the sabot is sometimes accompanied by a "wadding" (not depicted) which acts as a buffer between the sabot and the gunpowder (4) inside the shell (generally the rear end of the sabot itself acts as the wadding). The gunpowder in the shell sits inside the brass body and is ignited by the primer (6) which is struck by the shotgun's firing pin. When the shotgun's trigger is pulled, the firing pin strikes the primer, which ignites the gunpowder, which then burns. The expanding gas resulting from the burning powder pushes the sabot and slug through the shotgun's barrel and thereupon towards the target. The rifling of the shotgun's barrel grips the sabot, thereby rotating it and the slug inside the sabot, thereby stabilizing the slug's flight after it is fired. The sabot then falls away from the slug after the slug and sabot exit the shotgun's barrel and the slug continues its path towards the target.

Description of the Exterior of the Modified Shell

Figure 2B:
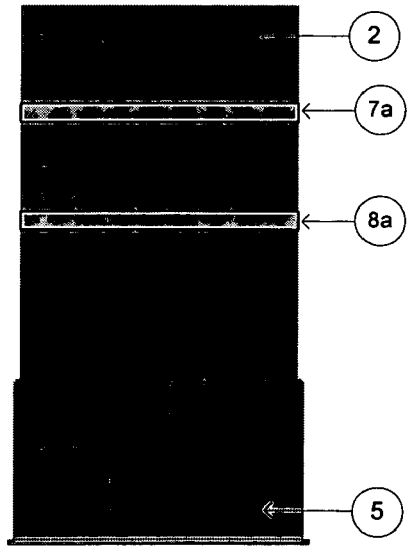
(prior art) Fig. 2B
FIG. 2B depicts the exterior of a Modified Shell component of the invention.

The exterior of the Modified Shell component of the invention is depicted in FIG. 2B. As seen in FIG. 2B, the Modified Shell differs from a standard shotgun shell in that the Modified Shell has two electrical contacts circling the hull (2) of the Modified Shell. These exterior contacts are labeled (7*a*) and (8*a*). An electric current will pass through these contacts during the operation of the invention, with the contact (7*a*) acting as the negative lead and contact (8*a*) acting as the positive lead. The exterior contacts should line the entire diameter of the Modified Shell so that the Modified Shell will always make contact with electrical contacts (7*e*), (8*e*) located inside the firing chamber of the Modified Shotgun.

The interior of the Modified Shell shall be described after a description of the Modified Slug which is inserted into the Modified Shell instead of shot pellets (1*a*) or a standard slug (1*b*).

Description of the Modified Slug

Figure 3A:
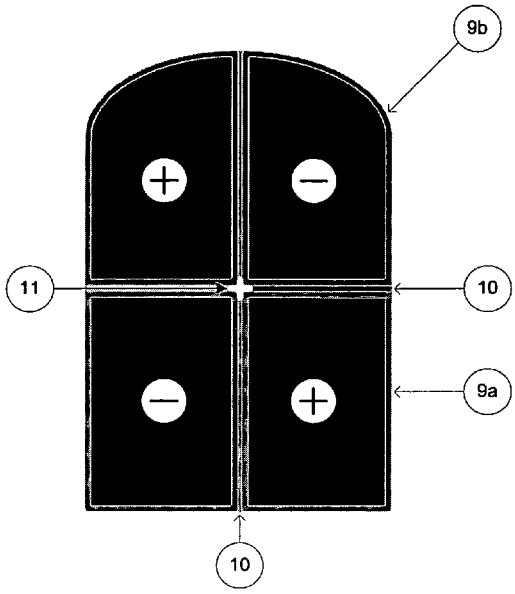
FIG. 3A depicts the lateral view of a Modified Slug used in a Modified Shell.
Figure 3B:
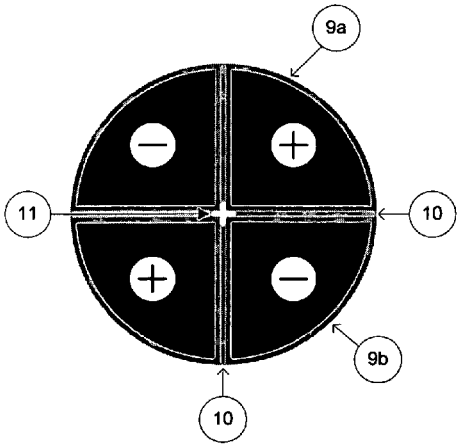
FIG. 3B depicts the front view of a Modified Slug used in a Modified Shell.
Figure 3C:
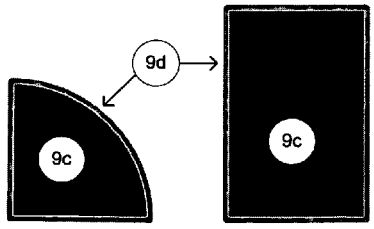
FIG. 3C depicts an individual piece used in the construction of a Modified Slug.

The Modified Slug, as depicted in FIGS. 3A and 3B, is placed inside the Modified Shell. The Modified Slug is formed from a plurality of Modified Shot Pellets. One such Modified Shot Pellet is depicted in FIG. 3C. Each Modified Shot Pellet is composed of a metal core (9*c*), preferably made of a dense metal such as lead, coated with an electrically conductive metal (9*d*), preferably copper. Because portions of the surface area of Modified Shot Pellets take the form of flat planar surfaces, the Modified Shot Pellets will act as "cubic shot" and have a wider dispersal pattern than conventional shot pellets (1*a*). The Modified Slug may be formed in an aerodynamic shape in order to lessen its drag during its path towards the target.

The Modified Shot Pellets are then bonded together using an epoxy (10) to form the Modified Slug as depicted in FIGS. 3A and 3B. The epoxy should have the property that it disbonds upon the application of an electric current. It is suggested that the ElectRelease™ epoxy is to be used as the epoxy for bonding the Modified Shot Pellets to form the Modified Slug. ElectRelease™ epoxy is produced by EIC Laboratories, Inc., of Norwood, Mass. (ElectRelease™ is a trademark of EIC Laboratories, Inc.). EIC maintains a website at the URL http://www.eiclabs.com/. ElectRelease™ epoxy disbonds upon the application of 10-50 volts of direct current at a low amperage. The Modified Slug should also be manufactured in accordance with the instructions applicable to the use of ElectRelease™ epoxy.

The Modified Slug also contains one or more spacers (11) constructed of a nonconductive material. As seen in FIGS. 3A and 3B, the one or more spacers are located in the Modified Slug in the spaces between the Modified Shot Pellets. The spacers are not bonded with the epoxy to the Modified Shot Pellets (the spacers may be constructed of a material, or coated with a material, to which the chosen epoxy does not bond). In the alternative, the Modified Slug may be constructed so that spaces of empty volume are used instead of the spacers.

The spacers also have the purpose of isolating "positive" Modified Shot Pellets (9*a*) from other "positive" Modified Shot Pellets, and likewise to isolate "negative" Modified Shot Pellets (9*b*) from other "negative" Modified Shot Pellets. The positive/negative sign of the Modified Shot Pellets indicates the flow of the electric current through the conductive coatings of the Modified Shot Pellets when the electric current from the Modified Shotgun enters the Modified Shell through its electrical contacts, as further described below. This construction creates a current path in which the electric current enters the Modified Shell, enters the Modified Slug through the "positive" labeled Modified Shot Pellets and then passes through the epoxy (thereby disbanding it) to the "negative" labeled Modified Shot Pellets. The "positive"/"negative" pairs of Modified Shot Pellets are set up in parallel through the use of the spacers; for a Modified Slug of eight pieces of shot (as in FIGS. 3A and 3B), there will be four circuits in parallel. The Modified Slug, however, may be constructed of a number of Modified Shot Pellets greater than eight or less than eight.

Figure 3D:
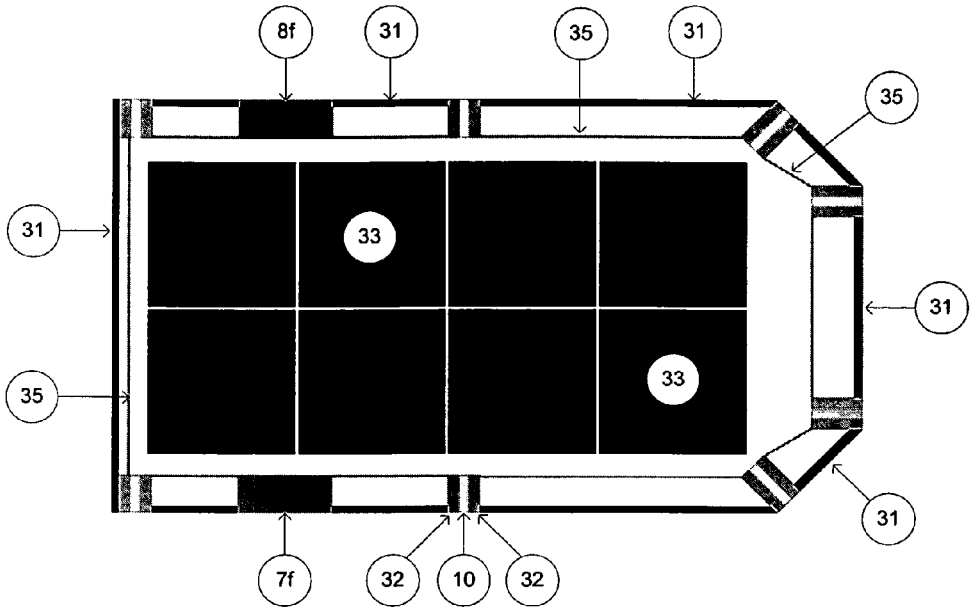
FIG. 3D depicts the lateral view of an alternative embodiment of the Modified Slug used in the Modified Shell.
Figure 3E:
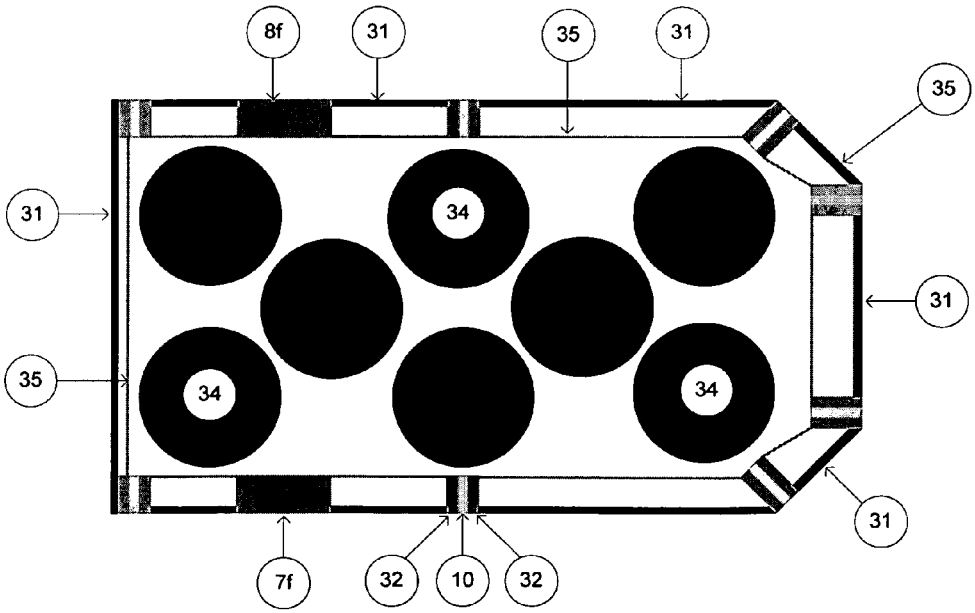
FIG. 3E depicts the lateral view of an alternative embodiment of the Modified Slug used in the Modified shell.

FIGS. 3D and 3E present another embodiment of the Modified Slug, in which the Modified Slug is constructed as a pre-formed hollow cylindrical shell made up of a group of plate segments (31) bonded together with epoxy (10) at small, electrically conductive areas (32) on the plate segments (31). The construction of the Modified Slug in this embodiment approximates "pre-fragmented" bullets currently on the market, such as the Glaser Safety Slug produced by Dakota Ammo, Inc./Glaser LLC, which maintains a website at http://www.dakotaammo.net.

In this embodiment of the Modified Slug, the pre-formed hollow cylindrical shell will contain pellets of shot, preferably cubic shot (33) formed as a cylinder inside the hollow cylindrical shell as depicted in FIG. 3D, although various weights of standard shot (34) may be used, as depicted in FIG. 3E. The shot pellets may be held in place by a matrix structure made of plastic or another material to better balance the Modified Slug (not depicted), which either falls away during the process of firing or after the shot has been fired, or which may be broken by the disbanding process that disbonds the segments of the Modified Slug. This embodiment of the Modified Slug may also be configured to contain a "disintegrator" Hatton round charge or a group of flechettes instead of the shot stored inside the Modified Slug.

Figure 5:
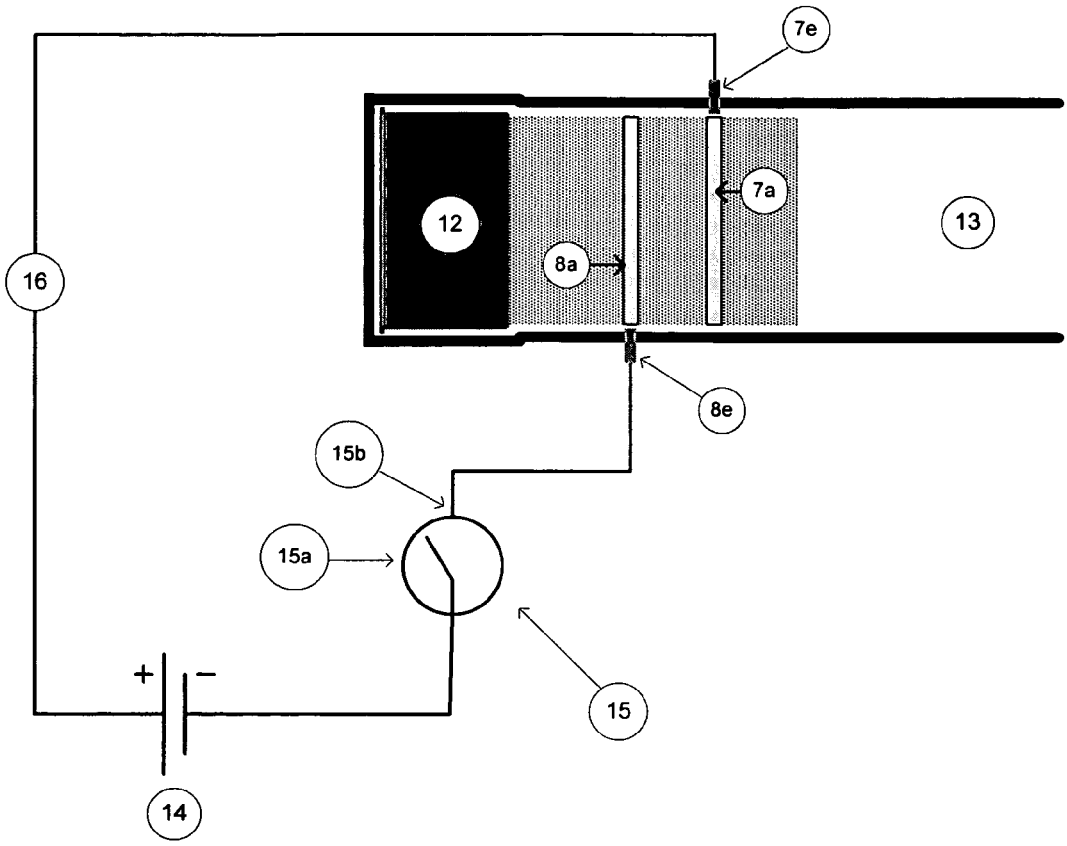
FIG. 5 depicts a circuit diagram of an embodiment of the Modified Shotgun and also depicts a Modified Shell inside the Modified Shotgun's firing chamber.

In this embodiment of the Modified Slug, the electrically conductive areas (32) on the plate segments (31) are connected via electrically conductive connections (35) within the Modified Slug, thereby forming parallel circuits within the Modified Slug. A power source (14) as shown in FIG. 5 will deliver electric current into the Modified Slug through the electrical contacts (7*f*) and (8*f*) located on the exterior of the hollow cylindrical shell. The epoxy (10) between the electrically conductive areas on the plate segments will disbond upon the application of the electrical current, causing the pre-formed hollow cylindrical shell to "fall apart" and transform from a "slug" form to a round of shot.

In another embodiment of the Modified Slug, the Modified Slug may be constructed from a number of Modified Pellets bonded with different amounts of epoxy wherein the amount used will vary according to the amount of current needed to disbond the epoxy. The Modified Shotgun, discussed below, will then have several different settings available on the selector switch, discussed below, whereby the operator may choose different types of shot to be fired by the Modified Shotgun. As an example, the selector switch may have three settings: "Slug," "Buckshot," and "Birdshot." When the switch is set to the "Buckshot" position, the Modified Slug will disbond to form eight pieces of buckshot, whereas if the switch is set to the "Birdshot" position, a stronger current will be applied and the Modified Slug will disbond to form a greater number of shot pellets, such as thirty-two.

In another embodiment of the Modified Slug presented in FIGS. 3A, 3B and 3C, electrically conductive material lines the exterior of the Modified Slug. The electrically conductive material is used to distribute the electric current to the Modified Shot Pellets. In this embodiment, the sabot of the Modified Shotgun Shell, described below, need not contain the electric conductors (7*c*), (8*c*), as the exterior contacts (7*a*), (8*a*) on the hull of the Modified Shell will make direct contact with the electrically conductive material lining the exterior of the Modified Slug through holes or openings made in the sabot.

Description of the Interior of the Modified Shell

Figure 4A:
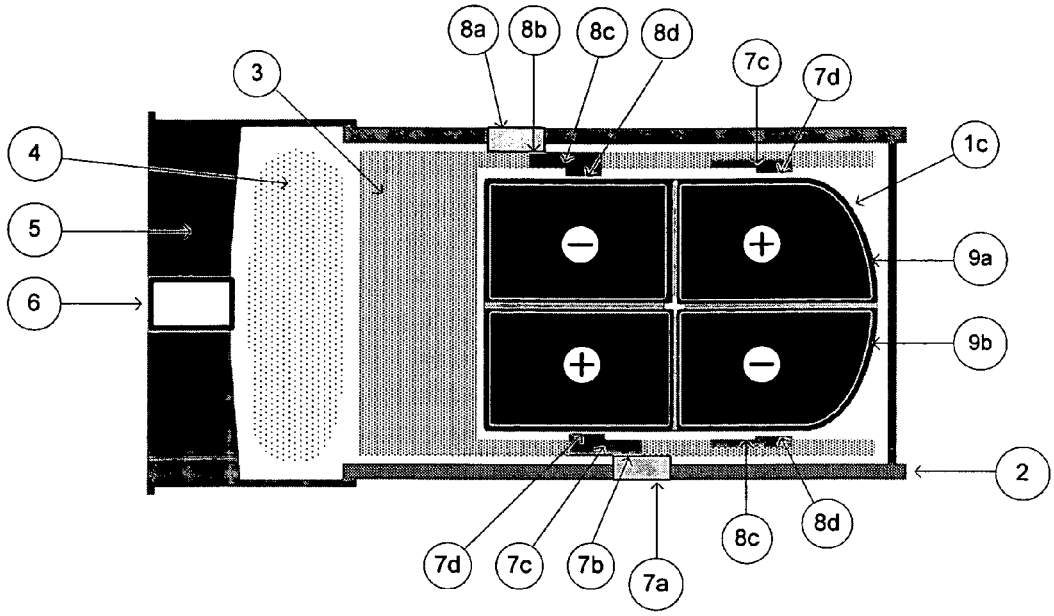
FIG. 4A depicts the lateral view of the interior of a Modified Shell.
Figure 4B:
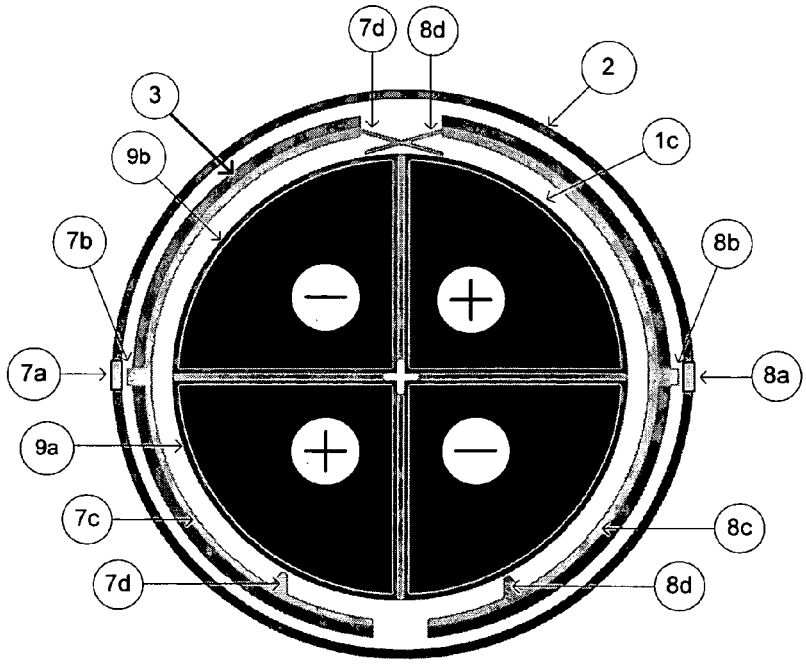
FIG. 4B depicts the front view of the interior of a Modified Shell.

FIGS. 4A and 4B depict the interior of the Modified Shell, which uses the Modified Slug (1*c*) as presented in FIGS. 3A and 3B. The Modified Slug is located inside a sabot (3) which is placed inside the hull (2) of the Modified Shell. The sabot has two electrical conductors (7*c*), (8*c*) located in or on the sabot. The electrical conductors may be constructed of a metal, such as copper, and be insulated except for the exposed portions at their points of contact with other components of the Modified Shell and Modified Slug. The electrical conductors may be attached to the inside surface of the sabot as insulated strips, or be installed inside the sabot itself with only the points of contact exposed. The sabot and hull of the Modified Shell are constructed so that they are insulated from the gunpowder charge (4) so that no accidental spark (should one occur) from the electric current flowing through the Modified Shell can cause a premature firing of the Modified Shell.

Each electrical conductor makes certain points of contact with the Modified Shot Pellets comprising the Modified Slug and with the exterior contacts (7*a*), (8*a*) on the hull of the Modified Shell. The electrical conductors are constructed so that they create a group of parallel circuits between the external contacts (7*a*) and (8*a*) through their points of contact with the Modified Slug. Each circuit includes one "positive" Modified Shot Pellet (9*a*) and one "negative" Modified Shot Pellet (9*b*). As an example, were the Modified Slug to contain eight Modified Shot Pellets, then the electrical conductors would create four parallel circuits between the external contacts (7*a*) and (8*a*).

As seen in FIGS. 4A and 4B, a portion of the electrical contacts (7*a*) and (8*a*) penetrates through the hull (2) of the shell. One contact (7*a*) on the hull makes physical contact at point (7*b*) with one electrical conductor (7*c*) installed in or on the sabot (3). The other contact (8*a*) on the hull makes physical contact at point (8*b*) with the other electrical conductor (8*c*) installed in or on the sabot. The electrical conductors (7*c*), (8*c*) are installed in or on the sabot and make a plurality of points of contact (7*d*), (8*d*) with the Modified Slug.

The electrical current that enters the Modified Slug will enter through the contact (7*a*) on the hull, passes through points (7*b*) of contact and into the first electrical conductor (7*c*) installed in or on the sabot. The current will pass through the first electrical conductor (7*c*) installed in or on the sabot and enter the Modified Slug at points 7(*d*). The current will pass through the Modified Shot Pellets labeled as (9*a*), through the epoxy (10) and to the Modified Shot Pellets labeled as (9*b*). The electric current will pass through the Modified Shot Pellets labeled as (9*b*) and through the points of contact (8*d*) to the second electrical conductor (8*c*) installed in or on the sabot. The current will pass through the point of contact (8*b*) between the second electrical conductor (8*c*) installed in or on the sabot and the contact (8*a*) on the hull.

Figure 4C:
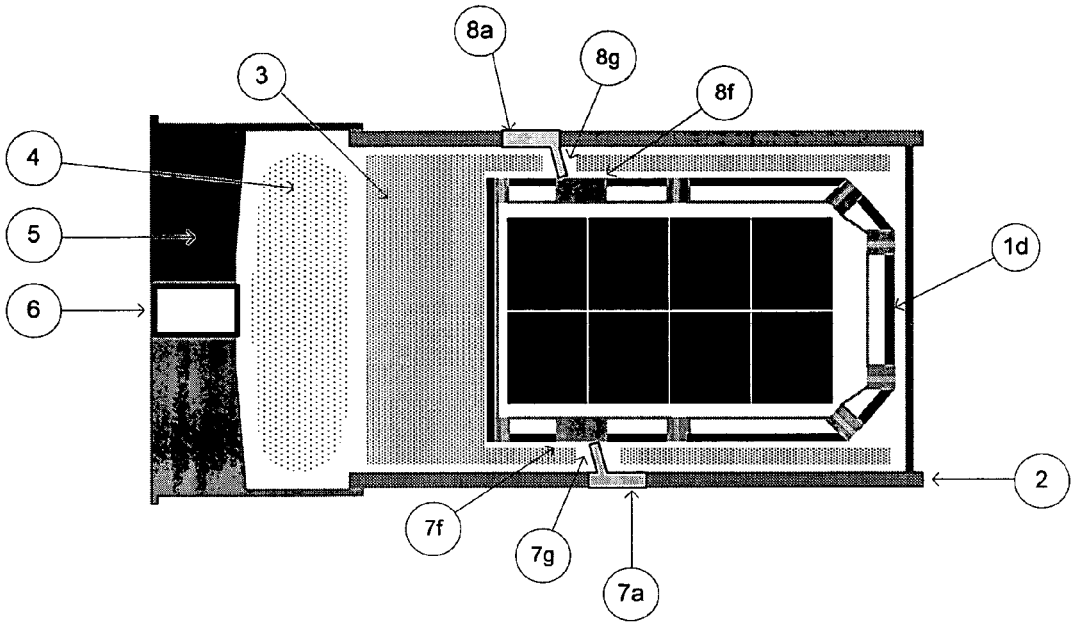
FIG. 4C depicts the lateral view of the interior of a Modified Shell using the Modified Slug depicted in FIGS. 3D and 3E.

If the Modified Shell contains the embodiment of the Modified Slug depicted in FIGS. 3D and 3E, the electrical conductors (7*c*), (8*c*) will make the points of contact (7*d*), (8*d*) with the contacts (7*f*), (8*f*) on the Modified Slug. In another embodiment, as presented in FIG. 4C, the electrical conductors (7*c*) and (8*c*) may be omitted from the Modified Shell, and the exterior contacts (7*a*) and (8*a*) may make direct contact with the electrical contacts (7*f*) and (8*f*) of the Modified Slug (1*d*) depicted in FIGS. 3D and 3E through openings (7*g*), (8*g*) made in the sabot.

Description of the Modified Shotgun

Figure 6:
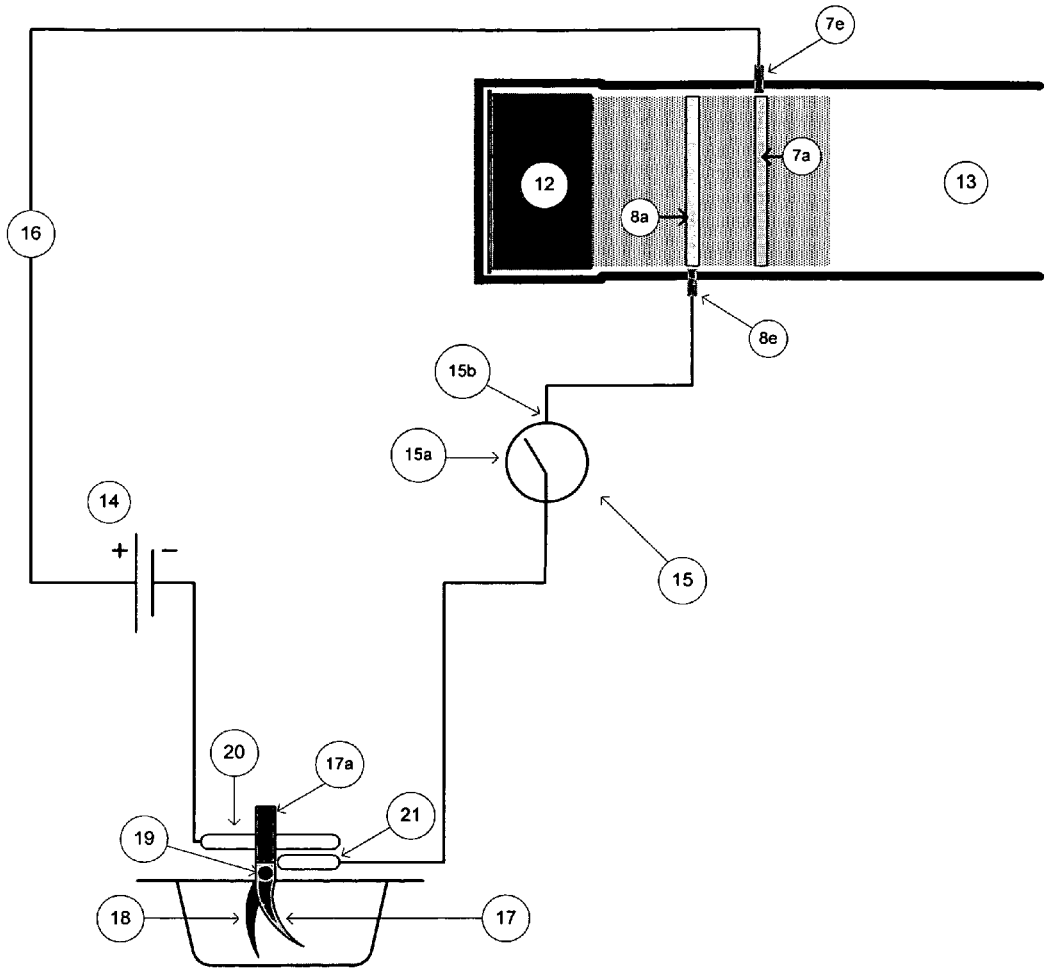
FIG. 6 depicts a circuit diagram of an embodiment of the Modified Shotgun, including a modified trigger component, and also depicts a Modified Shell inside the Modified Shotgun's firing chamber.
Figure 7A:
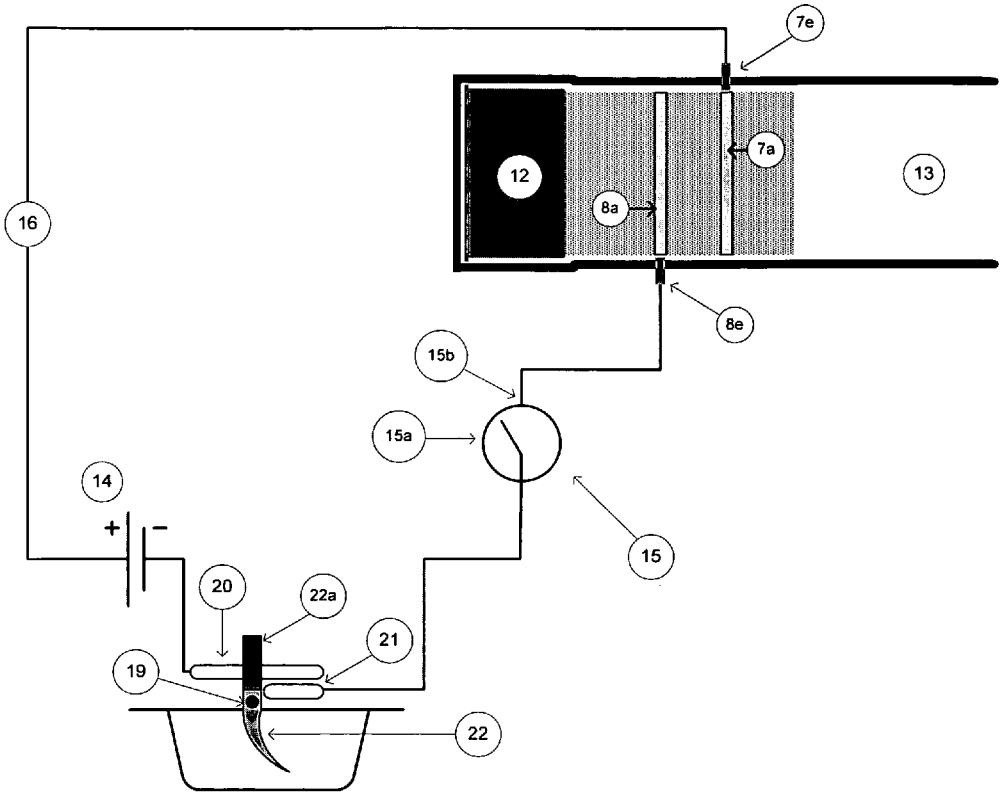
FIG. 7A depicts a circuit diagram of an embodiment of the Modified Shotgun, including a modified trigger component, and also depicts a Modified Shell inside the Modified Shotgun's firing chamber.

FIGS. 5, 6 and 7A depict the components of the Modified Shotgun as a circuit diagram and depict the Modified Shell (12) inside the firing chamber (13) of the Modified Shotgun.

The Modified Shotgun is a shotgun (preferably a pump-action or autoloading shotgun) with a rifled barrel in which two electrical contacts (7*e*), (8*e*) are located inside its firing chamber (13). The electrical contacts (7*e*) and (8*e*) are aligned so that they are in physical contact with the exterior contacts (7*a*) and (8*a*) on the Modified Shell when the Modified Shell rests in the firing chamber of the Modified Shotgun.

The electrical contacts (7*e*) and (8*e*) are connected by electrically conductive wiring (16) to a selector switch (15) and a power source (14), such as a battery, which are in or on the Modified Shotgun's frame, receiver and/or stock. Other electrical components (not pictured) may be included in this circuit to better regulate the flow of current from the power source.

The selector switch (15), which is installed in or on the Modified Shotgun in a manner so that the firearm's operator can easily manipulate it, has two positions: "Slug" (15*a*) and "Shot" (15*b*). The selector switch's "Off" position corresponds to the "Slug" position, while the selector switch's "On" position corresponds to the "Shot" position. The selector switch has a default "Off"/"Slug" position; in this position, no electrical current will flow, the epoxy in the Modified Slug will fail to disbond, and the Modified Slug will remain as a slug round. When the operator moves the selector switch to the "On"/"Shot" position, current flows from the power source through the circuit to the Modified Shell in the firing chamber, causing the epoxy in the Modified Slug to disbond, resulting in a round of shot in the Modified Shell. The selector switch may take the form of a push-button which the operator may operate to move the switch to the "On/Shot" position.

Description of the Modified Shotgun with a Modified Trigger Component

The Modified Shotgun may also contain a Modified Trigger component. The Modified Trigger component may take the form of an additional "switch trigger" added to the Modified Shotgun, as presented in FIG. 6, or as a "two-stage trigger," as presented in FIG. 7A.

FIG. 6 illustrates the "switch trigger" embodiment of the invention. In this embodiment, a secondary "switch trigger" (17) is installed near the primary trigger (18) which operates the firing mechanism of the Modified Shotgun. This trigger setup is akin to the "safety" triggers of certain firearms, such as pistols made by Glock and Springfield Armory, which are attached to the firing/primary trigger of such firearms. The function of the safety triggers on these pistols is to prevent the accidental firing of the weapon; the switch trigger (17) of the Modified Shotgun may also act in this capacity in addition to its primary function as an electric switch. In this embodiment, the operator of the Modified Shotgun will squeeze the switch trigger first, thereby causing the current to flow to the Modified Shell (if the selector switch (15) has been so set), after which the operator's finger will squeeze the primary trigger, thereupon discharging the Modified Shotgun.

The switch trigger (17) rotates about a pivot pin (19). The pivot pin may also be the same pin on which the primary trigger (18) rotates. The upper portion (17*a*) of the switch trigger (17) contains an electrically conductive portion. When the switch trigger is squeezed by the operator of the Modified Shotgun, the switch trigger rotates about the pivot pin and comes into contact with a first contact (20), made of an electrically conductive material, and a second contact (21) made of an electrically conductive material. Both contacts (20), (21) are attached by an electrically conductive material to the circuit drawn in FIG. 6, thereby allowing the electric current to pass from the first contact (20) through the upper portion (17*a*) of the switch trigger (17) to the second contact (21) when the switch trigger is squeezed. The current will pass through the contacts and upper portion of the switch trigger only when the selector switch (15) has been set to the "Shot" position (15*b*). In another embodiment of the invention, one of the contacts (20), (21) may itself be installed in or on the switch trigger.

The switch trigger (17) and contacts (20), (21) should be installed in the Modified Shotgun in a manner so that, when the operator releases both triggers (17), (18) after firing the Modified Shotgun, no contact is made between the switch trigger and the contacts as the triggers move back to their "ready to fire" position.

In another embodiment, the modified trigger component, as presented in FIG. 7A, takes the form of a single trigger (22) with a long "travel length," or the distance which the trigger moves before engaging the firing mechanism (such as releasing a sear which releases the firearm's hammer). Double-action firearms, such as revolvers, generally have longer travel lengths as their triggers have two functions: the trigger's first action moves a firing mechanism, such as a hammer or striker, into position during the first portion of the travel length, while the trigger's second action releases the hammer or striker during the second portion of the travel length. In the embodiment presented in FIG. 7A, the trigger (22) of the Modified Shotgun has been modified to have a longer travel length. The trigger (22) rotates about a pivot pin (19). The upper portion (22*a*) of the trigger (22) contains an electrically conductive portion.

As depicted in FIG. 7A, when the trigger (22) is squeezed by the operator of the Modified Shotgun, it rotates about the pivot pin (19) and performs a first action in which it comes into contact with a first contact (20), made of an electrically conductive material, and a second contact (21) made of an electrically conductive material. Both contacts (20), (21) are attached by an electrically conductive material to the circuit drawn in FIG. 7A, thereby allowing the electric current to pass from the first contact (20) through the upper portion (22*a*) of the trigger (22) to the second contact (21) when the trigger is squeezed. The current will pass through the contacts and upper portion of the trigger only when the selector switch (15) has been set to the "Shot" position (15*b*).

Figure 7B:
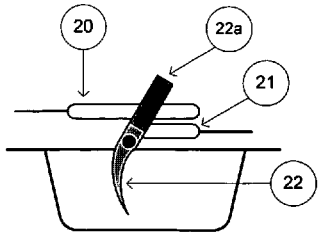
FIG. 7B depicts the first stage of the action of the modified trigger of the embodiment of the Modified Shotgun depicted in FIG. 7A.

The second action performed by the trigger (22) is depicted in FIG. 7B. During this second action, the operator continues to squeeze the trigger until it engages the firing mechanism, thereby discharging the Modified Shotgun. Both the first and second actions occur during one squeeze of the trigger over its longer travel length, analogous to the two actions involved in a double-action firearm.

The trigger (22) and contacts (20), (21) should be installed in the Modified Shotgun in a manner so that, when the operator releases the trigger (22) after firing the Modified Shotgun, no contact is made between the trigger and the contacts as the trigger moves back to its "ready to fire" position. In another embodiment of the invention, one of the contacts (20), (21) may itself be installed in or on the trigger (22).

Operation of the Invention/How to Use the Invention

A soldier or law enforcement official may operate the Modified Shotgun (loaded with the Modified Slugs) as described herein.

The operator of the Modified Shotgun designates a target and either estimates the range to the target or may use a range finding device to determine the range to the target (such as a distance estimator installed in a scope affixed to the Modified Shotgun). If the target is outside the range of a shot round, the operator fires the Modified Shotgun with the selector switch (15) in the default "Slug"/"Off" position (15*a*). The Modified Slug in the Modified Shell then leaves the rifled barrel of the shotgun as a slug which is stabilized in flight by the sabot. The selector switch may take the form of a push button, which the operator depresses while preparing to fire the Modified Shotgun.

Referring to FIG. 5, if the target is within the range of a shot round, the operator may turn the selector switch (15) to the "Shot"/"On" position (15*b*), thereby sending an electric current from the power source (14) to the Modified Shell. When the selector switch (15) is turned to the "Shot" position (15*b*), an electric current travels from the power source (14) along the electrically conductive wiring (16) to the contact (7*e*), thereupon entering the Modified Shell through the exterior contact (7*a*). The electrical current travels across the point of contact (7*b*) to the electrical conductor (7*c*) located in or on the sabot, across the point of contact (7*d*) to the "positive" Modified Shot Pellets (9*a*), across the epoxy (10), and to the "negative" Modified Shot Pellets (9*b*). The current then travels across the point of contact (8*d*) to the electrical conductor (8*c*) located in or on the sabot, across the point of contact (8*b*) and exits the Modified Shell through the exterior contact (8*a*), thereby completing the circuit. When the electric current flows through the epoxy (10), the current causes the epoxy to disbond, thereby causing the Modified Slug to "break apart" into a group of Modified Shot Pellets. When the operator then fires the Modified Shotgun, the Modified Slug round leaves the barrel in the form of a round of shot comprised of the Modified Shot Pellets instead of as a slug round.

If the Modified Slug takes the form of the embodiment presented in FIGS. 3D and 3E, the electric current pass across the point of contact (7*d*) and enters the Modified Slug through the contact (7*f*). The current then travels along the electrically conductive connections (35) within the Modified Slug to the electrically conductive areas (32) on the plate segments (31) and passes through the epoxy (10). The current then exits the Modified Slug at contact (8*f*), passes through point of contact (8*d*) and thereupon leaves the Modified Shell. As the current passes through the epoxy, the current causes the epoxy to disbond; the previously bonded junctions are now weakened or disconnected from each other, causing the plate segments (31) to separate. When the operator of the Modified Shotgun then discharges the weapon, the Modified Slug leaves the barrel of the Modified Shotgun as a round of shot instead of as a single projectile.

When armed with the Modified Shotgun, the operator may use the selector switch (depending upon the tactical situation in which he finds himself) in order to take advantage of the properties of a traditional slug round or a traditional shot round. This gives the operator a great deal of flexibility in choosing his ammunition in a short period of time. It also reduces the amount of time the operator must spend to choose which type of ammunition to fire in that the operator need only operate the selector switch on the Modified Shotgun in order to change from a slug round to a shot round; were the operator to use a "traditional" shotgun, he would be required to unload the firearm and then reload it with the different type of ammunition.

It should be noted that the default position of the selector switch is set to the "Slug" position. When the Modified Shell is loaded into the firing chamber, the operator has the option of either firing the slug round or moving the selector switch to the "Shot" position to modify the Modified Slug to a shot round. Once the operator has moved the selector switch, he cannot move it back to the "Slug" position in order to have another slug round ready for firing as it is not possible to "re-bond" the epoxy in the Modified Shell. The operator must instead fire the shot round and load another Modified Shell in order to fire a slug round. Thus, it may be preferable to install the selector switch as a "push button" which the operator will press immediately before firing the weapon. The addition of the Modified Trigger component, however, can allow the selector switch to be switched from "Slug" to "Shot" without disbanding the epoxy as the epoxy will not disbond until the Modified Trigger causes the current to flow to the Modified Shell.

In the first embodiment of the Modified Trigger, as presented in FIG. 6, the Modified Slug will remain as a slug round until the selector switch (15) is set to the "Shot" position (15*b*) and the operator squeezes the Switch Trigger (17) with the intention to fire a round of shot. Upon the movement of the Switch Trigger, the electrical current will flow, the epoxy in the Modified Shell will disbond, and the Modified Slug will become a round of shot. When the operator fires the Modified Shotgun, he must squeeze the Switch Trigger first, which will disbond the epoxy in the Modified Slug if the selector switch has been switched to "Shot," and will then squeeze the Primary Trigger, which will discharge the weapon. Both triggers will be squeezed in succession in a single action by the operator. As the operator will not squeeze the Switch Trigger until the operator is ready to fire the Modified Shotgun using the Primary Trigger, the operator may freely move the Selector Switch back to the "Slug" position from the "Shot" position. As described previously, the primary trigger (18) and switch trigger (17) should be designed so that when they return to the "ready to fire" position, no electrical current will flow between the contacts (20), (21).

Figure 7C:
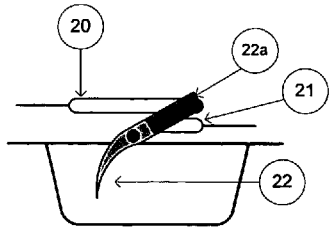
FIG. 7C depicts the second stage of the action of the modified trigger of the embodiment of the Modified Shotgun depicted in FIG. 7A.

In the second embodiment of the Modified Trigger, as presented in FIGS. 7A, 7B, and 7C, the Modified Slug will remain as a slug round until the selector switch (15) is set to the "Shot" position, and the operator engages the trigger through its first action, as described above, with the intention to fire a round of shot. Upon the movement of the trigger through its first action, the upper portion (22*a*) of the trigger (22) engages the contacts (20), (21), allowing the current to flow to the Modified Shell, thereby causing the epoxy to disbond and causing the Modified Slug to become a round of shot. When the operator fires the Modified Shotgun, he squeezes the trigger, which will first undergo its first action, as described above, and disbond the epoxy in the Modified Slug (if the Selector Switch has been switched to "Shot"). The squeezed trigger will then undergo its second action, as described above, and will discharge the weapon. As the operator will not squeeze the trigger until the operator is ready to fire the Modified Shotgun, the operator may freely move the Selector Switch back to the "Slug" position from the "Shot" position. As described previously, the primary trigger is designed so that when it returns to the "ready to fire" position, no electrical current flows between the contacts (20), (21).

DESCRIPTION OF A PREFERRED EMBODIMENT

A preferred embodiment of the invention is to use a pump-action shotgun with a rifled barrel as the basis for the Modified Shotgun, to use a Modified Shell as presented in FIGS. 4A and 4B, and to design the Modified Shotgun with a Modified Trigger component as presented in FIG. 6.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

I claim:

1. A shotgun shell, comprising:

a hull having a plurality of points of contact allowing the passage of an electric current into the shotgun shell, the points of contact constructed of an electrically conductive material;

a sabot having a plurality of leads constructed of electrically conductive material or a plurality of openings, the leads or openings allowing the passage of an electric current from the plurality of the points of contact on the hull to a projectile; and a projectile having a plurality of pellets constructed of a core of a dense metal coated by an electrically conductive material, the pellets held together by an epoxy, the epoxy having the characteristic that it disbonds upon the application of an electric current.

2. The shotgun shell of claim 1, wherein:

the projectile is a hollow cylinder containing a plurality of pellets and being constructed of a plurality of plates bonded together by an epoxy at electrically conductive areas on the plates, the epoxy having the characteristic that it disbonds upon the application of an electric current; and the projectile further has a plurality of points of contact constructed of an electrically conductive material, the points of contact allowing the passage of electric current to the electrically conductive areas on the plates.

3. The shotgun shell of claim 2, wherein the sabot has a plurality of openings whereby the plurality of points of contact on the hull make contact with the plurality of points of contact on the projectile, allowing the passage of an electric current to the projectile.

4. The shotgun shell of claim 1, wherein the projectile further has a plurality of points of contact constructed of an electrically conductive material, the points of contact allowing the passage of electric current to the electrically conductive material of the plurality of pellets; and the sabot has a plurality of openings whereby the plurality of points of contact on the hull make contact with the plurality of points of contact on the projectile, allowing the passage of an electric current to the projectile.

5. A combination of a shotgun and a shotgun shell, the combination comprising:

a shotgun shell including:

(a) a hull having a plurality of points of contact allowing the passage of an electric current into the shotgun shell, the points of contact constructed of an electrically conductive material, (b) a sabot having a plurality of leads constructed of electrically conductive material or a plurality of openings, the leads or openings allowing the passage of an electric current from the plurality of the points of contact on the hull to a projectile, and (c) a projectile having a plurality of pellets constructed of a core of a dense metal coated by an electrically conductive material, the pellets held together by an epoxy, the epoxy having the characteristic that it disbonds upon the application of an electric current; and a shotgun including:

(d) a firing trigger used to fire the shotgun, (e) an electric power source, (f) a selector switch with a plurality of positions, wherein at least one setting of the selector switch is a first position which causes no electric current to flow from the power source, and at least one setting of the selector switch is a second position which causes an electric current to flow from the power source, (g) a chamber in which are located a plurality of electrical contacts, the plurality of electrical contacts making contact with the plurality of points of contact on the hull of the shotgun shell when the shotgun shell is loaded into the chamber, and (h) electrically conductive material which forms a circuit comprising the power source, selector switch, and plurality of electrical contacts located in the chamber of the shotgun, the circuit completed when the shotgun shell is loaded into the chamber of the shotgun.

6. The combination of claim 5, wherein the selector switch takes the form of a push button.

7. The combination of claim 5, wherein the projectile of the shotgun shell is a hollow cylinder containing a plurality of pellets, flechettes or other particles and being constructed of a plurality of plates bonded together by an epoxy at electrically conductive areas on the plates, the epoxy having the characteristic that it disbonds upon the application of an electric current, and the projectile further has a plurality of points of contact constructed of an electrically conductive material, the points of contact allowing the passage of electric current to the electrically conductive areas on the plates.

8. The combination of claim 5, wherein the sabot has a plurality of openings whereby the plurality of points of contact on the hull make contact with the plurality of points of contact on the projectile, allowing the passage of an electric current to the projectile.

9. The combination of claim 5, wherein the projectile further has a plurality of points of contact constructed of an electrically conductive material, the points of contact allowing the passage of electric current to the electrically conductive material of the plurality of pellets, and the sabot has a plurality of openings whereby the plurality of points of contact on the hull make contact with the plurality of points of contact on the projectile, allowing the passage of an electric current to the projectile.

10. The combination of claim 5, further comprising:

a secondary trigger installed in the shotgun, the secondary trigger in physical proximity with the firing trigger, the secondary trigger having a portion constructed of electrically conductive material, the secondary trigger optionally acting as a safety for the shotgun; and a plurality of electrical contacts in physical proximity with the portion of the secondary trigger constructed of electrically conductive material, the plurality of electrical contacts made a part of the circuit formed by the electrically conductive material, the circuit becoming closed when the portion of the secondary trigger constructed of electrically conductive material is moved into physical contact with the plurality of electrical contacts.

11. The combination of claim 10, wherein the selector switch takes the form of a push button.

12. The combination of claim 10, wherein the projectile of the shotgun shell is a hollow cylinder containing a plurality of pellets, flechettes or other particles and being constructed of a plurality of plates bonded together by an epoxy at electrically conductive areas on the plates, the epoxy having the characteristic that it disbonds upon the application of an electric current, and the projectile further has a plurality of points of contact constructed of an electrically conductive material, the points of contact allowing the passage of electric current to the electrically conductive areas on the plates.

13. The combination of claim 10, wherein the sabot has a plurality of openings whereby the plurality of points of contact on the hull make contact with the plurality of points of contact on the projectile, allowing the passage of an electric current to the projectile.

14. The combination of claim 10, wherein the projectile further has a plurality of points of contact constructed of an electrically conductive material, the points of contact allowing the passage of electric current to the electrically conductive material of the plurality of pellets, and the sabot has a plurality of openings whereby the plurality of points of contact on the hull make contact with the plurality of points of contact on the projectile, allowing the passage of an electric current to the projectile.

15. The combination of claim 5, further comprising:

an electrically conductive component made a part of the firing trigger, the firing trigger constructed as a double-action trigger in which the second action of the firing trigger discharges the shotgun; and a plurality of electrical contacts in physical proximity with the electrically conductive component made a part of the firing trigger, the plurality of electrical contacts made a part of the circuit formed by the electrically conductive material, the circuit becoming closed when the electrically conductive component made a part of the firing trigger is moved into physical contact with the plurality of electrical contacts during the first action of the firing trigger.

16. The combination of claim 15, wherein the selector switch takes the form of a push button.

17. The combination of claim 15, wherein the projectile of the shotgun shell is a hollow cylinder containing a plurality of pellets, flechettes or other particles and being constructed of a plurality of plates bonded together by an epoxy at electrically conductive areas on the plates, the epoxy having the characteristic that it disbonds upon the application of an electric current, and the projectile further has a plurality of points of contact constructed of an electrically conductive material, the points of contact allowing the passage of electric current to the electrically conductive areas on the plates.

18. The combination of claim 15, wherein the sabot has a plurality of openings whereby the plurality of points of contact on the hull make contact with the plurality of points of contact on the projectile, allowing the passage of an electric current to the projectile.

19. The combination of claim 15, wherein the projectile further has a plurality of points of contact constructed of an electrically conductive material, the points of contact allowing the passage of electric current to the electrically conductive material of the plurality of pellets, and the sabot has a plurality of openings whereby the plurality of points of contact on the hull make contact with the plurality of points of contact on the projectile, allowing the passage of an electric current to the projectile.

* * * * *